United States Patent [19]

Flesher et al.

[11] 4,170,565

[45] Oct. 9, 1979

[54] SUBSTRATE ARTICLE FOR CLEANING FABRICS

[75] Inventors: Daniel J. Flesher, Springdale; Gary W. Kingry, Cincinnati, both of Ohio

[73] Assignee: The Procter & Gamble Company, Cincinnati, Ohio

[21] Appl. No.: 781,378

[22] Filed: Mar. 25, 1977

[51] Int. Cl.[2] ..... A47L 13/17; C11D 17/00; C11D 17/04

[52] U.S. Cl. ..... 252/93; 252/8.6; 252/8.8; 252/8.9; 252/90; 252/91; 252/92; 252/134; 252/174; 428/195; 428/212; 428/218; 428/246; 428/284; 428/304

[58] Field of Search ..... 252/90, 91, 92, 93, 252/134, 174, 8.6, 8.8, 8.9; 428/195, 212, 220, 246, 260, 289, 304, 305, 332, 284

[56] References Cited

U.S. PATENT DOCUMENTS

| | | | |
|---|---|---|---|
| 1,993,174 | 3/1935 | Coney | 252/93 |
| 3,121,249 | 2/1964 | Affleck | 252/91 |
| 3,816,321 | 6/1974 | Kleinschmidt | 252/134 |
| 3,955,920 | 5/1976 | Krauch | 8/137 |
| 4,066,394 | 1/1978 | Leonard | 8/137 |

FOREIGN PATENT DOCUMENTS

| | | | |
|---|---|---|---|
| 555575 | 7/1923 | France | 252/91 |
| 50-2940 | 1/1975 | Japan | 252/91 |
| 18592 | of 1889 | United Kingdom | 252/93 |

*Primary Examiner*—Dennis L. Albrecht

*Attorney, Agent, or Firm*—Robert B. Aylor; Thomas H. O'Flaherty; Richard C. Witte

[57] ABSTRACT

An article useful in a process for cleaning fabrics utilizing a water-insoluble substrate, having specifically defined air permeability and surface area characteristics, is disclosed. This article is added to the automatic washer at the beginning of its laundering cycle and provides excellent cleaning for fabrics washed therein. A method for cleaning fabrics, using these articles, is also disclosed.

4 Claims, No Drawings

SUBSTRATE ARTICLE FOR CLEANING FABRICS

BACKGROUND OF THE INVENTION

Since the home laundering operation is performed frequently in millions of homes throughout the United States and the world, much work has been done in an effort to make the operation more convenient and efficient. The laundry procedure generally requires the measuring and adding to the washing machine of a detergent composition as well as other laundry additives, such as bleaches, static control agents and fabric softeners. Thus, it would be desirable to use an article containing premeasured amounts of these compositions, which could be easily added to the washing machine without additional measuring.

Packages or articles containing premeasured amounts of laundry detergent compositions provide the user with a convenient way to add the detergent to an automatic washing machine, while simultaneously eliminating the necessity of measuring operations and their accompanying spillage and waste. In addition, desirable laundry additives, such as bleaches, static control agents and fabric softeners, may also be included in the package, thereby allowing the user to obtain multiple cleaning and fabric care benefits by simply dropping the premeasured portion into the washing machine at the beginning of the laundry operation. Prepackaged, premeasured articles must exhibit certain properties in order to be useful in the laundering operation. For example, as a result of the inherent nature of surface-active agents the articles must be formulated so as to be easy to handle and store, and should not be overly sticky when handled by the user, or when manufactured and packaged. Further, the articles must have a structure such that a sufficiently large amount of the detergent composition will be released into the washing solution during the relatively short washing cycle, in order to assure proper cleaning.

Premeasured laundry detergent compositions have been included in tablets and in water-soluble packets, such as those described in U.S. Pat. Nos. 3,503,889, Davis et al, issued Mar. 31, 1970; 3,198,740, Dunlop et al, issued Aug. 3, 1965; 3,413,229, Bianco et al, issued Aug. 26, 1968; and 3,186,869, Friedman, issued June 1, 1965.

Water-insoluble substrates have been used to introduce various active ingredients into certain laundering and washing operations. For example, U.S. Pat. No. 3,422,692, Gaiser, issued May 6, 1969, teaches a method for softening and controlling static on fabrics in a laundry washer or dryer, utilizing a fabric conditioning composition combined with a single layer substrate. See also U.S. Pat. No. 3,632,396, Perez Zamora, issued Jan. 4, 1972; and U.S. Pat. No. 3,686,025, Morton, issued Aug. 22, 1972. Such single layer substrates would generally not be useful for introducing laundry detergent compositions into a washing solution since it would be difficult to load the relatively large amounts of the compositions, which are required where conventional detergent active systems are used, on the substrate sheet. Further, single sheet articles would generally be quite sticky or uncomfortable to the touch and, therefore, would be difficult to handle and store, and could cause manufacturing and packaging problems.

Articles used for scrubbing, which have multiple substrate layers containing a cleaning composition, have been disclosed. Such a structure could solve the handling problem, described above, since the active system is completely surrounded by substrate layers. U.S. Pat. No. 2,389,736, Muise, issued Nov. 27, 1945 and Japanese Utility Model 02940/75, Kokoku Chemical Industry Company, Ltd., published Jan. 13, 1975, disclose this type of soap-containing article for use in the scrubbing of the hands and body. U.S. Pat. No. 2,655,528, Sternfield et al, issued Jan. 12, 1954, and U.S. Pat. No. 3,121,249, Affleck et al, issued Feb. 18, 1964, disclose this type of structure for disposable articles used in the washing and scrubbing of hard surfaces, such as dishes and counter tops. These articles rely on physical rubbing and scrubbing during use to assure the release of the proper amount of cleaning composition for the cleaning operation. Further, since many of these articles may be reused before they are discarded, it is important that they be formulated such that only a fraction of the cleaning composition contained in the article be released during any single use of the article.

It has now been found that by selecting water-insoluble substrate materials having specifically defined air permeability and surface area characteristics, a detergent article containing a laundry detergent composition between layers of this material, which yields complete or substantially complete release of the detergent composition into the washing solution during a conventional automatic laundering operation, and which is easy to handle and store, may be formulated. In addition, other desirable laundry benefits, such as bleaching, fabric softening and static control, may also be delivered to the laundered fabrics using the substrate articles of the present invention. An example of the delivery of such benefits is disclosed in concurrently filed U.S. Pat. No. 4,095,946, issued June 20, 1978, Jones and Kingry, Article for Cleaning and Conditioning Fabrics, incorporated herein by reference.

It is therefore an object of the present invention to provide a substrate article which effectively and conveniently cleans fabrics during a conventional automatic fabric laundering operation.

It is a further object of this invention to provide a substrate article which is not overly sticky when handled, and therefore is easy to manufacture, use and store.

It is a still further object of this invention to provide a substrate article which cleans fabrics during a conventional automatic laundry operation and which may be used to deliver additional benefits to the fabrics in both the automatic washer and subsequently in the automatic dryer.

It is also an object of this invention to provide a method for obtaining cleaning benefits for fabrics, utilizing a substrate detergent article.

SUMMARY OF THE INVENTION

According to the present invention there is provided an article useful in a process for cleaning fabrics, particularly in an automatic washer, consisting essentially of an effective amount of a surface-active composition comprising from about 5 to 95% by weight of a water-soluble surface-active agent contained between two layers of a water-insoluble, wet-strength substrate, at least one of said layers having an air permeability of at least about 10 cubic feet of air per minute per square foot of substrate.

Preferred substrates for use in these articles include flexible water-insoluble, wet-strength paper, woven cloth and nonwoven cloth substrates. Preferred articles have outside substrate surface areas in contact with the surface-active composition of from about 20 to about 450, particularly from about 37 to about 288, square inches.

In addition to the specifically defined substrate and surface-active agent components, the articles of the present invention may also include components which provide additional laundering or conditioning benefits to fabrics, or other adjunct components which are frequently found in detergent compositions. Examples of such components include: detergency builder salts, bleaching agents, fabric softening agents, static control agents, soil suspending agents, suds suppressing agents, corrosion inhibitors, dyes, optical brighteners, germicides, fillers, pH adjusting agents, enzymes, perfumes, and the like.

A method of cleaning fabrics, utilizing the substrate articles of the present invention in a conventional automatic washing machine, is also disclosed.

DETAILED DESCRIPTION OF THE INVENTION

The articles of the present invention provide a convenient and efficient way of introducing surface-active compositions into aqueous solutions, particularly laundry solutions in conventional automatic washing machines, and comprise a water-insoluble, wet-strength substrate having specific air permeability characteristics, as defined below, and a surface-active composition comprising from about 5 to 95% by weight of a water-soluble surface-active agent. These components will be discussed in detail hereinafter.

Substrates

The substrates employed herein are water-insoluble and are solid or substantially solid materials. They can be dense or open in structure, preferably the latter, and they must have an air permeability of at least 10 cubic feet of air per minute per square foot of substrate. The air permeability of the substrate is determined as hereinafter set forth. Examples of suitable materials which can be used as substrates, provided they meet the air permeability criteria defined herein include, among others, foam, foil, sponge, paper, woven cloth, and nonwoven cloth. Preferred substrates are made from a flexible material, and include those made from paper, woven cloth and nonwoven cloth. The term "cloth", as used herein, means a woven or nonwoven fabric or cloth used as a substrate, in order to distinguish it from the term "fabric" which is used to mean the textile fabric to be laundered.

The substrate materials used must exhibit sufficient wet-strength so as to maintain their structural integrity through a complete washing cycle, and possibly a cycle in an automatic dryer. Preferred substrates have a wet tensile strength of at least 150, preferably 200, grams 1 inch. Further, the substrates should exhibit essentially the same thermal stability characteristics as do the fabrics to be laundered, i.e., they should not melt or ignite at temperatures below about 300° F., preferably about 425° F., in order to permit their use in automatic clothes dryers. It is also preferred that the substrates be of a material which passes Federal Flammability Commercial Standard CS 191-53, so that they may be safely used in an automatic dryer. Preferred substrate materials should exhibit only a minimal amount of linting when used in automatic washers and dryers. Preferably, the substrates employed in the articles of the present invention are wet-strength paper or nonwoven cloth substrates.

At least one of the outer substrate layers must exhibit an air permeability of at least about 10 cubic ft. of air per minute per sq. ft. of substrate in order to be useful in the articles of the present invention. It is preferred that both substrate layers have air permeabilities of at least about 10 cubic feet per minute per sq. ft. Materials having air permeabilities less than 10 cubic ft. per minute per sq. ft. will not permit the release of a sufficient amount of the surface-active composition into the laundry solution, during the relatively short automatic laundering cycle, in order to provide satisfactory cleaning. It is preferred that the substrate used has an air permeability of at least about 15 cubic ft. per minute per sq. ft., more preferably about 30 cubic ft. per minute per sq. ft., and most preferably about 70 cubic ft. per minute per sq. ft. Preferred substrates for use in the articles of the present invention have dimensions ranging from about 2"×2" up to about 20"×20". Substrates larger than 20" square may be used in the present invention, but they tend to be unwieldy to handle and take up relatively large amounts of space in the conventional washing machine. When larger size substrates are used, the chances of the article becoming trapped in other clothing articles, thereby preventing release of the detergent composition into the laundry solution, are decreased. Preferred substrates range in size from about 3"×4" to about 15"×15", particularly from about 4"×6" to about 12"×12".

In conjunction with these substrate dimensions, preferred articles of the present invention have surface areas ranging from about 10 to about 800 square inches, particularly from about 20 to about 450 square inches, most preferably from about 37 to about 288 square inches. As used in this context, the term "surface area" refers to the total surface area of the two outside substrate sheets which are in contact with the surface-active composition of the present article. It does not include those areas devoid of surface active agent; for example, the flat seams or borders along which the substrates may be joined. For specific substrate dimensions, surface areas and materials, experimentation within the ranges defined herein will easily determine the particular air permeability which results in the optimal release of the surface-active composition into the laundry solution. For example, where the substrates used have dimensions of from about 4"×6" to about 12"×12", and surface areas ranging from about 37 sq. in. to about 288 sq. in., it is preferred that the substrates used have an air permeabilities of at least about 20, preferably at least about 30, and most preferably at least about 70, cubic ft. of air per minute per sq. ft. of substrate. Where the substrates used have dimensions in the range of from about 4"×6" to about 8"×9", and surface areas ranging from about 37 square inches to about 150 square inches, it is preferred that their air permeabilities be at least about 55, preferably at least about 100, more preferably at least about 130, particularly at least about 175, cubic ft. of air per minute per sq. ft. of substrate. On the other hand, where the dimensions of the substrate used are from about 8"×9" to about 12"×12", and the surface area is in the range of from about 150 sq. in. to about 288 sq. in., it is preferred that the substrates have air permeabilities of at least about 20, preferably at least about 30, and most preferably at least about 70, cubic ft. of air per minute per sq. ft. of substrate.

The air permeabilities of the substrate materials may be determined using a Model V Portable Air Permeability Tester (Albany Engineered Systems Industrial Fabrics Division). A sample of the material is clamped into the tester and air is pulled through the sample at a constant pressure drop (0.5 inches of water). The pressure drop through a calibrated orifice is then read and is converted to Standard Air Permeability (measured at a pressure drop of 0.5 inches of water), in cubic ft. per minute per square ft., by means of a conversion chart.

The substrates used in the articles of the present invention may have a thickness varying from about 10 to about 1,000 mils, preferably from about 20 to about 750 mils, and most preferably from about 25 to about 500 mils. Where the surface-active composition, contained in the articles of the present invention, is in a paste, gel, liquid or viscous liquid form, the use of substrate materials having a thickness within the ranges described above will minimize the bleeding of the composition through the substrate, thereby making the article easier to package, store and handle.

Paper substrates which can be employed herein encompass the broad spectrum of known paper structures and are not limited to any specific papermaking fiber or wood pulp. Thus, the fibers derived from soft woods, hard woods, or annual plants, such as bagasse, cereal straw, and the like, and wood pulps, such as bleached or unbleached kraft, sulfite, soda ground wood, or mixtures thereof, can be used. Moreover, the paper substrate materials which can be employed in the articles of the present invention are not limited to specific types of paper, so long as the paper exhibits the required wet strength, thermal stability, and air permeability characteristics.

A specific example of a type of paper substrate material preferred herein is a two-ply paper having a basis weight of about 50 pounds per 2,880 sq. ft. made from, for example, a mixture of ground wood and kraft bleached wood pulps. Another example is the absorbent, multi-ply toweling paper which is disclosed in U.S. Pat. No. 3,414,459, Wells, issued Dec. 3, 1968, said patent being incorporated herein by reference.

The preferred nonwoven cloth substrates which may be used in the invention herein are generally defined as adhesively bonded fibrous products, having a web or corded fiber structure (where the fiber strength is suitable to allow carding) or comprising fibrous mats, in which the fibers are distributed haphazardly or in a random array (that is, an array of fibers in a carded web wherein partial orientation of the fibers is frequently present as well as a completely haphazard distributional orientation) or substantially aligned. The fibers can be natural, such as wool, silk, jute, hemp, cotton, linen, sisal, or ramie; or synthetic, such as rayon, cellulose ester, polyvinyl derivatives, polyolefins, polyamides, or polyesters. Any diameter or denier of fiber, generally up to about 10 denier, are useful in the present invention.

Methods of making nonwoven cloths suitable for use herein are not a part of this invention and, being well known in the art, are not described in detail in this application. Generally, such cloths are made by dry- or water-laying processes in which the fibers are first cut to desired lengths from long strands, passed into a water or air stream, and then deposited onto a screen through which the fiber-laden air or water is passed. The deposited fibers are then adhesively bonded together, dried, cured, and otherwise treated as desired to form the nonwoven cloth. Nonwoven cloths made of polyesters, polyamides, vinyl resins, and other thermoplastic fibers can be spun bonded. In this process the fibers are spun out onto a flat surface and bonded (melted) together by heat or by a chemical reaction.

When the substrate component of the articles described herein is a nonwoven cloth made from fibers deposited haphazardly or in a random array on a screen, the articles exhibit excellent strength in all directions and are not prone to tear or separate when used successively in an automatic washer and dryer.

Preferably, the nonwoven cloth is water-laid or dry-laid and is made from cellulosic fibers, particularly from regenerated cellulose or rayon, which have been lubricated with a standard textile lubricant. It is preferred that the fibers are from about 3/16 inch to about 2 inches in length, and are from about 1.5 to about 5 denier. It is also preferred that the fibers are at least partially oriented haphazardly, particularly substantially haphazardly, and are adhesively bonded together with a hydrophobic or substantially hydrophobic binder resin, particularly with a non-ionic self-crosslinking acrylic polymer or a mixture of such polymers. A preferred cloth comprises by weight about 85% fiber and about 15% binder resin polymer, and has a basis weight of from about 50 to about 90 grams per square yard.

The substrates used in the articles of the present invention may be treated such that they adsorb dirt and dyes suspended in the laundry solution. Examples of such substrates are disclosed in U.S. Pat. No. 3,694,364, Edwards, issued September 26, 1972 and U.S. Pat. No. 3,816,321, Kleinschmidt, issued June 11, 1974, both of which are incorporated herein by reference. Preferred articles of this type include such ion exchange-treated substrates, having the air permeability characteristics required herein, together with non-granular laundry detergent compositions. Either granular or non-granular detergent compositions may be used in articles where the substrate is not ion exchange-treated. Generally, it is preferred that substrates in the articles of the present invention are not ion exchange-treated, since such substrates are less expensive and easier to manufacture than the treated substrates.

If the articles are formulated so as to be used in the automatic dryer, subsequent to their use in the automatic washer, the substrates used may be formed such that they have slit or aperture openings in order to improve their functioning in the dryer. These openings may also improve the release of the surface-active composition in the automatic washer. However, in order to be used in the articles of the present invention, it is desirable that the substrate materials meet the air permeability criteria set forth herein in the absence of the slits. Such openings are described in U.S. Pat. No. 3,944,694, McQueary, issued Mar. 16, 1976; U.S. Pat. No. 3,956,556, McQueary, issued May 11, 1976; U.S. Pat. No. 4,007,300, McQueary, issued Feb. 8, 1977, and U.S. Pat. No. 4,012,540, McQueary, issued Mar. 15, 1977, all of which are incorporated herein by reference.

The substrates usable herein can be "dense", or they can be open and have a high amount of "free space", as long as they satisfy the previously defined air permeability criteria. Free space, also called "void volume", is that space within a substrate structure which is unoccupied. For example, certain absorbent, multi-ply paper structures comprise plies embossed with proturberances, the ends of which are mated and joined. This type of paper structure has free space between the unembossed portions of the plies, as well as between the fibers of the paper plies themselves. A nonwoven cloth also has such space between its fibers. The free space of the substrate can be varied by modifying the density of the fibers of the substrate. Thus, substrates with a high amount of free space generally have low fiber density, and substrates having a high fiber density generally have a low amount of free space. The amount of free space which a material has is not critical to its employment as a substrate herein, although it may have a direct effect on the air permeability of the substrate material. However, the amount of free space in the substrate structure may affect the amount of the surface-active composition or fabric conditioning components which must be applied to the substrate in order to achieve a desired coating effect.

Examples of particular substrate materials which are useful in the articles of the present invention include: duPont Reemay 2470, air permeability about 135 cu.ft./minute/sq.ft., basis weight 179.5 g/sq.yd., thickness 35 mils; International Paper 463, air permeability about 180 cu.ft./minute/sq.ft., basis weight 75.9 g/sq.yd., thickness 14 mils; International Paper 491, air permeability about 42 cu.ft./minute/sq.ft., basis weight 74.5 g./sq.yd., thickness 10.5 mils; and International Paper 1125R, air permeability about 140 cu.ft./minute/sq.ft., basis weight 70 g/sq.yd., thickness 12.6 mils. Particularly preferred substrate materials for use herein include Scott 8050 Industrial Towel, air permeability about 120–140 cu.ft./minute/sq.ft., basis weight 77.5 g./sq.yd., thickness 44 mils; melt-blown polypropylene material having an air permeability of about 60–70 cu.ft./minute/ sq.ft., basis weight 58.5 g./sq.yd., thickness 29 mils; Stevens S835, air permeability about 400 cu.ft./minute/ sq.ft., basis weight 54 g./sq.yd., thickness 24 mils; Stevens 9008, air permeability about 455 cu.ft./minute/sq.ft., basis weight 56 g./sq.yd., thickness 27.5 mils; and Stearns & Foster 2847-13, air permeability about 380 cu.ft./minute/sq.ft., basis weight 88 g./sq.yd., thickness 29 mils.

The Surface-Active Composition

In addition to the substrate component, described above, the articles of the present invention additionally contain a surface-active composition, preferably a laundry detergent composition, which comprises from about 5 to 95% by weight of a water-soluble surface-active agent, carried between the outer layers of substrate. Any detersive surfactant or mixture of such surfactants known in the art may be used in the articles of the present invention. It is preferred that the surface-active composition carried by the substrate articles contain from about 15 to 90% by weight of the surfactant component, most preferably from about 20 to 85% of the surfactant.

Preferred water-soluble surface-active agents for use in the articles of the present invention include those selected from the group consisting of anionic surfactants, nonionic surfactants, zwitterionic surfactants, and mixtures thereof. These water-soluble surfactants include any of the common anionic, nonionic, and zwitterionic detersive surfactants well known in the detergency arts. The surfactants listed in U.S. Pat. No. 3,717,630, Booth, issued Feb. 20, 1973 and U.S. Pat. No. 3,332,880, Kessler et al, issued July 25, 1967, both of which are incorporated herein by reference, are useful in the present invention. Specific nonlimiting examples of surfactants suitable for use in the instant compositions are as follows:

Water-soluble salts of the higher fatty acids, i.e., "soaps," are useful as an anionic surfactant herein. This class of surfactants includes ordinary alkali metal soaps such as the sodium, potassium, ammonium, and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactant includes water-soluble salts, particularly the alkali metal, ammonium and alkanolammonium salts, of orlganic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present detergent compositions are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkylbenzene sulfonates, in which the alkyl group contains from about 9 to about 15 carbon atoms in straight chain or branched chain configurations, e.g., those of the type described in U.S. Pat. Nos. 2,220,099 and 2,477,383, incorporated herein by reference.

Other anionic surfactant compounds useful herein include the sodium alkyl glyceryl ether sulfonates, especially those ethers or higher alcohols derived from tallow and coconut oil; sodium conconut oil fatty acid monoglyceride sulfonates and sulfates; and sodium or potassium salts of alkyl phenol polyethylene oxide ether sulfate containing about 1 to about 10 units of ethylene oxide per molecule and wherein the alkyl groups contain from about 8 to about 12 carbon atoms.

The alkaline earth metal salts of synthetic anionic surfactants are useful in the present invention. In particular, the magnesium salts of linear alkylbenzene sulfonates, in which the alkyl group contains from 9 to about 15, especially 11 to 13, carbon atoms, are useful.

Other useful anionic surfactants herein include the water-soluble salts of esters of $\alpha$-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Preferred water-soluble anionic organic surfactants for use herein include linear chain alkylbenzene sulfonates containing from about 10 to 16 carbon atoms in the alkyl group; alkyl sulfates containing from about 10 to 20 carbon atoms; the coconut range alkyl glyceryl sulfonates; and alkyl ether sulfates wherein the alkyl moiety contains from about 10 to 20 carbon atoms and wherein the average degree of ethoxylation varies between about 1 and 6.

Specific preferred anionic surfactants for use herein include: sodium linear $C_{10}$–$C_{12}$ alkylbenzene sulfonate; triethanolamine $C_{10}$–$C_{12}$ alkylbenzene sulfonate; sodium tallow alkyl sulfate; sodium coconut alkyl glyceryl ether sulfonate; and the sodium salt of a sulfated condensation product of $C_{14}$–$C_{18}$ alcohol with from about 1 to about 10 moles of ethylene oxide.

It is to be recognized that any of the foregoing anionic surfactants can either be used separately or in mixtures.

Most commonly, nonionic surfactants are compounds produced by the condensation of an alkylene oxide, especially ethylene oxide (hydrophilic in nature), with an organic hydrophobic compound, which is usually aliphatic or alkyl aromatic in nature. The length of the hydrophilic polyoxyalkylene moiety which is condensed with any particular hydrophobic compound can be readily adjusted to yield a water-soluble compound having the desired degree of balance between hydrophilic and hydrophobic properties. Examples of nonionic surfactants suitable for use herein include:

(1) The polyethylene oxide condensates of alkyl phenols.

These compounds include the condensation products of alkyl phenols having an alkyl group containing from about 6 to 12 carbon atoms in either a straight chain or branched chain configuration with ethylene oxide, said ethylene oxide being present in an amount equal to 5 to 25 moles of ethylene oxide per mole of alkyl phenol. The alkyl substituent in such compounds can be derived, for example, from polymerized propylene, diisobutylene, and the like. Examples of compounds of this type include nonyl phenol condensed with about 9.5 moles of ethylene oxide per mole of nonyl phenol; dodecyl phenol condensed with about 12 moles of ethylene oxide per mole of phenol; dinonyl phenol condensed with about 15 moles of ethylene oxide per mole of phenol; and di-isooctylphenol condensed with about 15 moles of ethylene oxide per mole of phenol. Commercially available nonionic surfactants of this type include Igepal CO-630 marketed by the GAF Corporation, and Triton X-45, X-114, X-110 and X-102, all marketed by the Rohm and Haas Company.

(2) The condensation products of aliphatic alcohols with from about 1 to about 25 moles of ethylene oxide. The alkyl chain of the aliphatic alcohol can be either straight or branched, primary or secondary, and generally contains from about 8 to about 22 carbon atoms. Examples of such ethoxylated alcohols include the condensation product of about 6 moles of ethylene oxide with 1 mole of tridecanol; myristyl alcohol condensed with about 10 moles of ethylene oxide per mole of myristyl alcohol; the condensation product of ethylene oxide with coconut fatty alcohol wherein the coconut alcohol is a mixture of fatty alcohols with alkyl chains varying from 10 to 14 carbon atoms in length and wherein the condensate contains about 6 moles of ethylene oxide per mole of alcohol; and the condensation product of about 9 moles of ethylene oxide with the above-described coconut alcohol. Examples of commercially available nonionic surfactants of this type include Tergitol 15-S-9 marketed by Union Carbide Corporation, Neodol 23-6.5 marketed by Shell Chemical Company and Kyro EOB marketed by The Procter & Gamble Company.

(3) The condensation products of ethylene oxide with a hydrophobic base formed by the condensation of propylene oxide with propylene glycol. The hydrophobic portion of these compounds has a molecular weight of from about 1500 to 1800 and exhibits water insolubility. The addition of polyoxyethylene moieties to this hydrophobic portion tends to increase the water-solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic surfactants marketed by Wyandotte Chemicals Corporation.

(4) The condensation products of ethylene oxide with the product resulting from the reaction of propylene oxide and ethylenediamine. The hydrophobic moiety of these products consists of the reaction product of ethylenediamine and excess propylene oxide, said moiety having a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by Wyandotte Chemicals Corporation.

Nonionic surfactants may also be of the semi-polar type including water-soluble amine oxides containing one alkyl moiety of from about 10 to 28 carbon atoms and two moieties selected from the group consisting of alkyl groups and hydroxyalkyl groups containing from 1 to about 3 carbon atoms; water-soluble phosphine oxides containing one alkyl moiety of about 10 to 28 carbon atoms and two moieties selected from the group consisting of alkyl groups and hydroxyalkyl groups containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

In the detergent compositions used in the instant invention it is preferred that the particular nonionic surfactants employed have a hydrophilic-lipophilic balance (HLB) of from about 8 to about 15. Preferred nonionic surfactants are the condensation products of alkyl phenols, having 6–12 carbon atoms in the alkyl group, with from about 5 to 25 moles of ethylene oxide, and the condensation products of $C_8$–$C_{22}$ aliphatic alcohols with from about 1 to 15 moles of ethylene oxide, and mixtures thereof. Highly preferred nonionic surfactants are the condensation products of at least 5 moles of ethylene oxide with a $C_{10}$–$C_{16}$ aliphatic alcohol.

Another preferred nonionic surfactant herein comprises a mixture of "surfactant" and "co-surfactant" as described in U.S. Pat. application Ser. No. 557,217, Collins, filed Mar. 10, 1975, the disclosure of which is incorporated herein by reference. The term "nonionic surfactant" as employed herein encompasses these preferred mixtures of Collins.

Zwitterionic surfactants include derivatives of aliphatic quaternary ammonium, phosphonium, and sulfonium compounds in which the aliphatic moieties can be straight or branched chain, and wherein one of the aliphatic substituents contains from about 8 to 18 carbon atoms and one contains an anionic water-solubilizing group. Particularly preferred zwitterionic materials are the ethoxylated ammonium sulfonates and sulfates disclosed in U.S. Pat. No. 3,925,262, Laughlin et al, issued Dec. 9, 1975; U.S. Pat. No. 3,929,678, Laughlin et al, issued Dec. 30, 1975; and U.S. patent application Ser. No. 603,837, Laughlin et al, filed August 11, 1975, all of which are incorporated herein by reference. The inclusion of these surfactants in the compositions give excellent clay soil removal performance.

Particularly preferred ethoxylated zwitterionic surfactants are those having the formulae:

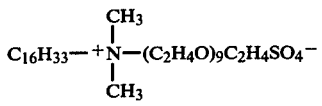

and

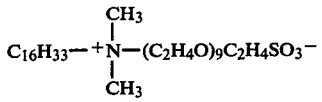

Additional preferred zwitterionic surfactants include those having the formula

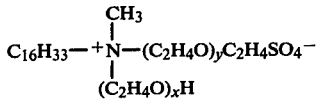

wherein the sum of x+y is equal to about 15.

The surface-active compositions which are included in the articles of the present invention may also, in addition to the surfactant component, contain adjunct components which are frequently found in detergent compositions, or may contain components which deliver additional benefits to the laundered fabrics. The articles may be formulated so as to deliver these additional benefits in the washer, along with the cleaning benefit, or they may be carried out with the laundry into the automatic dryer, where the additional fabric care benefits are released. Thus, for example, by utilizing the teachings of concurrently filed U.S. patent application Ser. No. 781,399, Jones, "Article and Method for Fabric Softening and Static Control"; U.S. Pat. No. 4,095,946, issued June 20, 1978, Jones and Kingry, "Article for Cleaning and Conditioning Fabrics"; and U.S. Pat. No. 4,113,630, issued Sept. 12, 1978, Hagner and Wissel, "Article for Conditioning Fabrics", all of which are incorporated herein by reference, articles of the present invention which deliver fabric softening and static control benefits in the dryer, in addition to cleaning in the washer, may be formulated.

In another embodiment the articles are made with substrates having areas of different air permeabilities. By loading different cleaning and fabric conditioning components on the various areas of the substrate, the articles will sequentially release the components throughout the laundering operation. Preferred substrate articles are those in which at least one of the outer substrate layers has areas of different air permeabilities, and wherein at least a substantial portion of the substrate layers have an air permeability of at least about 10 cubic ft. per minute per sq. ft. For example, if an article is made from a substrate, a portion of which has an air permeability less than about 10 cu.ft./minute/sq.ft., while a substantial portion of the substrate has an air permeability of at least about 10, preferably about 30, and most preferably about 70, cu.ft./minute/sq.ft., part of the surface-active composition or other components contained in the article, will be held in the article through the wash cycle and will be released into the laundry solution during the rinse cycle. Thus, a substrate could be made out of polypropylene, such that half of the substrate has an air permeability of 66 cu.ft./minute/sq.ft. and a basis weight of about 70 g./sq.m. and the other half of the substrate has an air permeability of about 4–13 cu.ft./minute/sq.ft. and a basis weight of about 200–250 g./sq.m. The substrate is then evenly coated and/or impregnated with a laundry detergent composition, covered with an identical sheet of substrate material, and the high air permeability area separated from the low air permeability area by heat sealing or sewing. When this article is used in a conventional automatic laundry operation, substantially all of the detergent composition in the high air permeability side will be released during the washing cycle, while about 10–20% of the composition contained in the low permeability side will not be released into the laundry solution until the rinse cycle.

The surface-active compositions used in the articles of the present invention may include builder salts, especially alkaline, polyvalent anionic builder salts. These alkaline salts serve to maintain the pH of the cleaning solution in the range of from about 7 to about 12, preferably from about 8 to about 11, and enable the surfactant component to provide effective cleaning, even where hardness cations are present in the laundry solution. It is preferred that the builder salts are present in an amount of from about 1 to 60%, more preferably from about 15 to 35%, by weight of the surface-active compositions; although by the proper selection of surfactants and other components, effective detergent compositions which are free or essentially free of builder salts may be formulated for use herein.

Suitable detergent builder salts useful herein can be of the polyvalent inorganic or polyvalent organic types, or mixtures of these varieties. Nonlimiting examples of suitable water-soluble, inorganic alkaline detergent builder salts include: alkali metal carbonates, borates, phosphates, polyphosphates, bicarbonates, silicates, and sulfates. Specific examples of such salts include the sodium and potassium tetraborates, perborates, bicarbonates, carbonates, tripolyphosphates, orthophosphates, pyrophosphates and hexametaphosphates.

Examples of suitable organic alkaline detergency builder salts include:

(1) water-soluble aminopolyacetates, for example, sodium and potassium ethylenediamine tetraacetates, nitrilotriacetates, and N-(2-hydroxyethyl)nitrilotriacetates;

(2) water-soluble salts of phytic acid, for example, sodium and potassium phytates; and (3) water-soluble polyphosphonates, including sodium, potassium, and lithium salts of ethane-1-hydroxy-1,1-diphosphonic acid; sodium, potassium, and lithium salts of methylenediphosphonic acid; and the like.

Additional organic builder salts useful herein include the polycarboxylate materials described in U.S. Pat. No. 3,364,103, incorporated herein by reference, including the water-soluble alkali salts of mellitic acid. The water-soluble salts of polycarboxylate polymers and copolymers, such as those described in U.S. Pat. No. 3,308,067, incorporated herein by reference, are also suitable as builders herein.

While the alkali metal salts of the organic and inorganic polyvalent anionic builder salts and anionic surfactants previously disclosed are preferred for use herein from an economic standpoint, the ammonium, and alkanolammonium, such as triethanolammonium, diethanolammonium, monoethanolammonium, and the like, water-soluble salts of any of the foregoing detergent and builder anions may also be used herein.

A further class of detergency builder materials useful in the present invention are insoluble sodium aluminosilicates, particularly those described in Belgian Pat. No. 814,874, issued Nov. 12, 1974, incorporated herein by reference. This patent discloses and claims detergent compositions containing sodium aluminosilicates having the formula $Na_z(AlO_2)_z(SiO_2)_y.XH_2O$, wherein z and y are integers equal to at least 6, the molar ratio of z to y is in the range of from 1.0:1 to about 0.5:1, and X is an integer from about 15 to about 264, said aluminosilicates having a calcium ion exchange capacity of at least 200 milligrams equivalent/gram and a calcium ion exchange rate of at least about 2 grains/gallon/minute/gram. A preferred material is $Na_{12}(SiO_2.AlO_2)_{12}.27H_2O$.

Mixtures of organic and/or inorganic builders may be used herein. One such mixture of builders is disclosed in Canadian Pat. No. 755,038 and consists of a ternary mixture of sodium tripolyphosphate, trisodium nitrilotriacetate, and trisodium ethane-1-hydroxy-1,1-diphosphonate.

Other preferred builder materials which may be used in the articles of the present invention include alkali metal carboxymethyltartronates, commercially available as about 76% active together with about 7% ditartronate, about 3% diglycolate, about 6% sodium carbonate and about 8% water; and anhydrous sodium carboxymethylsuccinate, commercially available as about 76% active together with about 22.6% water and a mixture of other organic materials, such as carbonates.

While any of the foregoing alkaline polyvalent builder materials are useful herein, sodium tripolyphosphate, sodium nitrilotriacetate, sodium mellitate, sodium citrate, and sodium carbonate are preferred for use as builders. Sodium tripolyphosphate is especially preferred as a builder, both by virtue of its detergency building activity and its ability to suspend illite and kaolinite clay soils and to retard their redeposition on the fabric surface.

Bleaching agents may also be incorporated into the surface-active compositions used in the articles of the present invention. Examples of typical bleaching agents are chlorinated trisodium phosphate and the sodium and potassium salts of dichloroisocyanuric acid.

The surface-active compositions used in the present invention may also contain other adjunct materials commonly used in detergent compositions. Examples of such components include various soil-suspending agents, such as carboxymethylcellulose, corrosion inhibitors, dyes, fillers, such as sodium sulfate and silica, optical brighteners, suds suppressing agents, germicides, pH adjusting agents, antiwrinkling agents, enzymes, enzyme stabilizing agents, perfumes, and the like. In addition, up to about 5%, preferably from about 0.3 to 1%, of $TiO_2$ may be added to paste or liquid detergent compositions used in the present invention to inhibit bleeding through the substrate layers.

In making the articles of the present invention, it is preferred that the surface-active composition is substantially completely contained between the two outer layers of the substrate material. The surface-active composition may be either impregnated into or coated onto the substrate material. The term "coating" connotes the adjoining of the composition to the surface of the substrate. This coating may be done in long continuous strips or in smaller discrete areas on the substrate surface. "Impregnation" means the permeation of the entire substrate structure, with the surface-active composition. Any conventional methods for coating or impregnating the substrate with the surface-active composition may be used in forming the articles of the present invention. Some of the ways in which the composition may be applied to the substrate material include dipping, spraying, or by a gravure or rotary screen printing process.

The surface-active composition is applied to the substrate in an amount which would, under normal washing conditions, be effective to provide adequate cleaning of the soiled fabrics. Preferred articles of the present invention carry from about 3 to about 120 grams, particularly from about 20 to about 80 grams, of the composition. The exact amount of surface-active composition necessary to achieve this cleaning will be determined by the particular type of composition used and the surface-active agent contained in it.

It is particularly preferred that where the surface-active composition contains anionic surfactants, nonionic surfactants or mixtures of nonionic and anionic surfactants, that the article contains from about 17 to 120 grams of the composition; and where the surface-active composition contains zwitterionic surfactants, cationic surfactants or mixtures of zwitterionic or cationic surfactants with other water-soluble surfactants, that the article contain from about 3 to 120 grams of the composition.

In one embodiment of the present invention, a substrate, having the specifically defined air permeability characteristics previously discussed, is coated on one side with a laundry detergent composition. A second sheet of the substrate material is then placed over the coated side of the bottom substrate sheet, and the perimeter of the two sheets are sealed together, such as by adhesive, sewing or heat sealing. In another embodiment a number of individual inner plies of a multi-ply substrate are either coated or impregnated with a laundry detergent composition. The outside substrate plies are not treated with the detergent composition, and all layers are combined and sealed around the edges. This embodiment provides an article which is untreated on its outer surfaces, and yet contains within it several other plies, each of which is treated on one or both sides. Articles of the present invention may also be formed by coating or impregnating one or more layers of foam, sponge, paper, woven cloth or nonwoven cloth, with the detergent composition, placing untreated substrate plies around these layers and sealing the perimeter edges of the outer substrate layers. These embodiments provide articles which rapidly release the detergent composition into the laundry solution during a conventional automatic laundering operation, which are not sticky to the touch of the user, and which are easy to manufacture, handle and store. Additional fabric conditioning components, such as those described in concurrently filed U.S. patent application Ser. No. 781,399, Jones, "Article and Method for Fabric Softening and Static Control", incorporated herein by reference, may be included on the inside or outside of the substrate articles.

The use of the substrate articles of the present invention provides a convenient and efficient method whereby soiled fabrics may be cleaned. The substrate article is placed in an automatic washing machine together with the fabrics to be laundered, preferably at the start of the washing cycle, and is allowed to remain there until the washing cycle is completed. During this process, the surface-active composition and other fabric conditioning components which are contained in the substrate article are released into the washing solution and provide cleaning and other benefits to the fabrics washed therein. If the substrate article additionally contains any dryer-activated fabric conditioning components, the washed fabrics and the substrate article are placed in an automatic dryer, where they are subjected to the drying cycle. In the course of this drying operation, the dryer-activated fabric conditioning components are released, providing additional benefits to the laundered fabrics. The articles of the present invention also provide a convenient way to pretreat particularly dirty fabrics. This is accomplished by rubbing the soiled area with the article, which has been dampened, prior to placing the article and the clothing into the wash.

All percentages, parts, and ratios stated in this application are by weight unless otherwise specified.

The following nonlimiting examples illustrate the articles and the method of the present invention.

EXAMPLE I

Substrate articles, having the component formulation below, were formulated in the following manner:

| Component | % by weight |
|---|---|
| Sodium $C_{11.8}$ linear alkylbenzene sulfonate | 13.8 |
| Sodium $C_{14-16}$ alkyl polyethoxylate sulfate | 6.7 |
| Sodium silicate solids (2.0r) | 13.1 |
| Sodium tripolyphosphate | 26.0 |
| Tallow fatty acid | 0.5 |
| Water | 39.6 |
| Minors | 0.3 |

8"×11" substrate sheets, made of melt blown polypropylene of differing air permeabilities, were loaded with about 70 grams of the above detergent composition, in the form of a paste. The paste was thinly spread over the surface of one side of the substrate sheet, leaving a clean perimeter edge approximately ½" wide. A second sheet of the polypropylene material having the same air permeability was then placed over the coated side of the bottom sheet, and the edges of the two sheets were bonded together by heat sealing. Articles were made out of substrate materials having air permeabilities of about 75 cubic feet per minute per square foot and about 3 cubic feet per minute per square foot.

The cleaning capabilities of each of these substrate articles was then tested, and compared to the cleaning capabilities of the above detergent composition in past form, using the following method. Each substrate article, and the neat detergent product, was added to a Kenmore Automatic Washing Machine, Model No. 72860-110, together with a typical 5½ lb. load of clothes containing six identical polyester swatches stained with a clay-in-water suspension. A complete washing cycle was run for each article and the neat product using identical laundry conditions (regular agitation cycle, 100° F. wash water, 5.5 grains per gallon of mixed hardness). The fabrics were then dried for 50 minutes in a Kenmore Electric Dryner, Model No. 76690-100. A Hunter Reflectometer was then used to obtain a reflectance reading for each of the laundered swatches. The cleaning effectiveness of each substrate article was determined by averaging the reflectance readings of each swatch laundered with the article and comparing these results to those obtained by using the neat product. The test results are summarized below. A difference of about 5 Hunter whiteness units represents a visually detectable cleaning difference, based upon laboratory grading by nonexpert observers.

| | Air permeability (cu.ft./min./sq.ft.) | Reflectance Average (Hunter Whiteness Units) |
|---|---|---|
| Neat detergent composition | — | 25 |
| 8" × 11" substrate article | 75 | 24 |
| 8" × 11" substrate article | 3 | 18 |

The data demonstrate that the substrate article of the present invention (i.e., that having an air permeability of about 75 cubic ft. per minute per sq. ft.) yielded cleaning performance which is essentially equivalent to that of the detergent composition added directly into the laundry solution. In addition, the substrate article of the present invention provided a convenient, efficient, easy to handle method of adding the detergent composition to the laundry solution, without the necessity of actually having to measure out the composition. Further, it is seen, that visually inferior cleaning was obtained where the laundry article was made out of a substrate material falling outside of the air permeability ranges required for the present invention (i.e., that having an air permeability of about 3 cubic ft. per minute per sq. ft.).

Comparable cleaning results to those obtained above using the 75 cubic ft. per minute per sq. ft. article are obtained where the air permeability of the polypropylene substrate sheet is about 25, 40, 50, 85, 100 or 150 cu.ft./min./sq.ft.

Substantially similar cleaning results are obtained when the substrate used is an 11"×11", an 8"×11", an 8"×6", or a 4"×6" sheet of a Scott 8050 Industrial Towel, having an air permeability of about 130 cu.ft./min/sq.ft., a basis weight of about 77.5 grams per sq.yd. and a thickness of 44 mils. Similar cleaning results are also obtained where the substrates used in the articles are duPont Reemay 2470, International Paper 463, Stevens 9008 or Stearns & Foster 2847-13.

Substantially similar results are also obtained when the anionic surfactants contained in the articles of the present invention are sodium, calcium, or magnesium-neutralized anionic surfactants, such as $C_{10}$–$C_{16}$ branched chain alkylbenzene sulfonates, $C_{10}$–$C_{16}$ alkyl sulfates, or $C_{10}$–$C_{16}$ alkyl ether sulfates.

Comparable results are also obtained when the substrate articles contain a nonionic surfactant, such as a secondary $C_{11}$–$C_{15}$ alcohol condensed with 9 moles of ethylene oxide (Tergitol 15-S-9), the condensation product of $C_{12}$–$C_{13}$ alcohol with an average of 5 moles of ethylene oxide, wherein the mono- and unethoxylated fractions are stripped away (Neodol 23-3T), or the condensation product of nonylphenol with 9 moles of ethylene oxide (Igepal CO-630).

Similar results are also obtained when the builder used in the substrate articles is a water-insoluble aluminosilicate builder, such as hydrated sodium Zeolite A with an average particle size of from 1 to 10 microns, sodium pyrophosphate, sodium carbonate, or sodium 2-oxy-1,1,3-propane tricarboxylate.

EXAMPLE II

Substrate articles of the present invention, having the component formulation given below, were formulated in the following manner:

| Component | % by weight |
|---|---|
| Condensation product of $C_{14-15}$ alcohol with an average 7 moles of ethylene oxide per mole of alcohol (Neodol 45-7) | 29.5 |
| Triethanolamine | 5.8 |
| Magnesium $C_{11-8}$ linear alkylbenzene sulfonate | 56.8 |
| Moisture | 4.0 |
| Minors | 3.9 |

Bottom substrate sheets, made of Scott 8050 Industrial Towel, having an air permeability of about 130 cu.ft./min/sq.ft., were cut into different sizes and loaded with about 35 grams of the above-described detergent composition, in the form of a paste. The paste was thinly spread over the surface of one side of the substrate sheet, leaving a clean perimeter edge approximately ½" in width. A second substrate sheet of the same material and size was then placed over the coated side of the first sheet and all four edges of the substrate article were sealed together by sewing. In this manner, 8"×11" and 3"×3" substrate articles were produced.

The cleaning performance of each of the substrate articles, compared to the cleaning performance of a comparable amount of the neat detergent composition, was then determined using the following method. Each substrate article was individually added to a Kenmore Automatic Washing Machine, Model No. 72680-110, together with a typical 5½ lb. load of clothing which contained six identical cotton swatches stained with dirty motor oil. A complete washing cycle, under identical conditions, was then run for each article (regular agitation cycle, 100° F. wash water, 5.5 grains per gallon hardness). The fabrics were then dried for 50 minutes in a Kenmore Electric Dryer, Model No. 76690-100. The percentage stain removal for each swatch was calculated utilizing light reflectance readings, obtained on a Gardner color measurement device, for each swatch before and after the washing process. Swatch results were averaged for each substrate article and were compared to the cleaning results obtained using the neat detergent product (added directly to the washing machine).

The results are summarized in the table below.

| | Surface area(sq.in) | Average % removal |
|---|---|---|
| Neat detergent composition | — | 80 |
| 8" × 11" substrate article | ~140 | 80 |
| 3" × 3" substrate article | ~15 | 70 |

It is seen that the cleaning performance of the neat detergent composition and the preferred substrate article of the present invention (i.e., the 8"×11" article) were essentially equivalent, while, at the same time, the substrate article of the present invention provided a more convenient and efficient way in which to add the detergent composition to the washing machine. Further, it is seen that the cleaning capabilities of the substrate article decrease when the article falls outside of the preferred dimension and surface area ranges stated herein (i.e., the 3"×3" article).

EXAMPLE III

A laundry article of the present invention is formed by coating a detergent composition, having the formulation given below, on one side of an 8"×10¾" sheet of a paper towel, comprising by weight about 75% wood pulp, 15% rayon, and 10% latex binder. The paper towel has an air permeability of about 135–150 cubic ft. of air per minute per sq. ft., a basis weight of 77.5 g/sq.yd. and a thickness of 44 mils. An identical sheet of the paper towel is placed on top of the coated original sheet, and the edges of the two sheets are sewn together, so as to enclose the detergent composition between the two substrate sheets.

A softening and static control mixture of a quaternary ammonium material and a dispersion inhibitor, as described in the table below, formed by comelting the components, is then applied to the outer surface of the substrate in a 3" wide strip.

| Component | Grams of Component/ substrate article |
|---|---|
| Detergent composition: | |
| Sodium $C_{11.8}$ linear alkylbenzene sulfonate | 9.2 |
| Sodium $C_{14-16}$ alkyl polyethoxylate sulfate | 4.6 |
| Sodium silicate solids (2.0r) | 9.2 |
| Sodium tripolyphosphate | 24.4 |
| Tallow fatty acid | 0.4 |
| Water and minors | 25.0 |
| Softening and static-control mixture: | |
| Ditallowalkyldimethylammonium chloride | 2.7 |
| Tallow alcohol | 0.9 |

The substrate article is added to a load of soiled fabrics in a Kenmore automatic washing machine. The fabrics consist of 5½ lbs. of clothing, containing both synthetic and natural fiber garments, and are washed in a regular agitation cycle, in 100° F. wash water which have a thickness of 7 grains of mixed calcium and magnesium per gallon. At the conclusion of the washing cycle, the clothing, together with the substrate article, is transferred from the washer to a Kenmore electric dryer which is then run through a 50 minute drying cycle. The article is found to deliver both excellent cleaning and static control performance to the fabrics laundered with it. In addition, the article is easy to store and package, and is not unsatisfactorily sticky to the touch when handled by the user.

Comparable cleaning results are obtained where the air permeability of the paper towel substrate sheet is about 25, 40, 50, 70, 100 or 175 cubic ft. per minute per sq. ft.

Substantially similar cleaning results are obtained when the substrate used is an 11"×11", an 8"×11", an 8"×6", or a 4"×6" sheet of melt-blown polypropylene, having a thickness of about 29 mils, a basis weight of 58.5 g/sq. yd., and an air permeability of about 66 cubic ft. per minute per sq. ft.

Substantially similar results are also obtained when the anionic surfactants contained in the article of the present invention are sodium-, calcium-, or magnesium-neutralized anionic surfactants, such as $C_{10}$–$C_{16}$ branched chain alkylbenzene sulfonates, $C_{10}$–$C_{16}$ alkyl sulfates, or $C_{10}$–$C_{16}$ alkyl ether sulfates.

Comparable results are also obtained when the substrate article contains a nonionic surfactant, such as a secondary $C_{11}$–$C_{15}$ alcohol condensed with 9 moles of ethylene oxide. (Tergitol 15-S-9), the condensation product of $C_{12}$–$C_{13}$ alcohol with an average of 5 moles of ethylene oxide, wherein the mono- and unethoxylated fractions are stripped away (Neodol 23-3T), or the condensation product of nonyl phenol with 9 moles of ethylene oxide (Igepal CO-630).

Similar results are also obtained when the builder used in the substrate articles is a water-insoluble aluminosilicate builder, such as hydrated sodium zeolite A with an average particle size of from 1 to 10 microns, sodium pyrophosphate, sodium carbonate, or sodium 2-oxy-1,1,3-propane tricarboxylate.

Similar softening and static-control results are obtained where, in addition to the detergent composition, the article contains, as the quaternary ammonium component, ditallowalkyldimethylammonium methyl sulfate, dicetyldimethylammonium chloride, didodecyldimethylammonium chloride, ditallowalkyldimethylammonium bromide, dioleoyldimethylammonium hydroxide, ditallowalkyldipropylammonium chloride, ditallowalkyldibutylammonium fluoride, or cetyldecylmethylethylammonium chloride.

Comparable softening and static-control results are also obtained where the dispersion inhibitor used in the intimate mixture carried by the substrate is replaced by myristyl alcohol, cetyl alcohol, stearyl alcohol, lauric acid, myristic acid, palmitic acid, stearic acid, sorbitan trilaurate, sorbitan trimyristate, sorbitan tetrapalmitate, or sorbitan tetrastearate.

EXAMPLE IV

A substrate article of the present invention is formulated utilizing the detergent composition formulation given below.

| Component | Grams of Component/ Substrate Article |
|---|---|
| Condensation product of $C_{14-15}$ alcohol with 7 moles of ethylene oxide per mole of alcohol (Neodol 45-7) | 28.3 |
| Triethanolamine | 6.6 |
| Magnesium $C_{11.8}$ linear alkylbenzene sulfonate | 59.0 |
| Tallow fatty acid | 1.9 |
| $TiO_2$ | 0.5 |
| Moisture and minors | 3.7 |

A 3"×5" sponge, about ⅜" thick, is coated with about 32.5 grams of the above detergent composition, in the form of a thick paste. Two 4"×6" sheets of a commercially marketed paper towel, having an air permeability of about 175 cubic ft./minute/sq.ft., a basis weight of 55 g/sq. yd. and a thickness of about 35 mils, are then placed around the coated sponge and all four edges of the substrates are sewn together, such that the sponge is completely enclosed by the substrate sheet.

This substrate article provides excellent cleaning when it is used in a conventional automatic laundering operation. Further, the article is not unsatisfactorily sticky when handled by the user, and does not stick to other articles when packaged and stored.

Substantially similar cleaning results are obtained where the 4"×6" substrate sheets used have air permeabilities of about 55, 95, 125, 150 and 200 cubic ft. per minute per sq. ft. Similar cleaning results are also obtained where three 3"×5" sponge inserts, each about ⅛" thick, are used in the above substrate article.

Excellent cleaning results are also obtained where an 8"×6" sheet of the same substrate material used in this example is coated on one side with the detergent formulation given above. The substrate is then folded in half to produce a 4"×6" article containing the detergent composition within it. The substrate layers are held together by the detergent composition, and it is not necessary to seal the edges of the article.

EXAMPLE V

A substrate article, for use in both an automatic washer and dryer, containing the detergent composition defined below, is made as follows:

| Component | % By Weight |
|---|---|
| Detergent Composition: | |
| Neodol 45-7 | 25.4 |
| Triethanolamine | 5.9 |
| Magnesium $C_{11.8}$ linear alkylbenzene sulfonate | 53.0 |
| Tallow fatty acid | 1.7 |
| Moisture and minors | 4.1 |
| Softening and static-control mixture: | |
| Ditallowalkyldimethylammonium methyl sulfate | 5.2 |
| Tallow alcohol | 2.5 |
| Sorbitan monostearate | 2.2 |

An 11"×11" substrate sheet, made of melt-blown polypropylene, having an air permeability of about 65 cubic ft. per minute per sq. ft., a basis weight of 58.5 g/sq. yd. and a thickness of about 29 mils, is loaded with 32.7 grams of the detergent composition described above, in the form of an essentially anhydrous paste. The paste is thinly spread over the surface of one side of the substrate sheet, leaving a clean perimeter edge approximately ½ inch wide. A second sheet of the same polypropylene material is loaded with an intimate mixture of th ditallowalkyldimethylammonium methyl sulfate, tallow alcohol and sorbitan monostearate components described above. In forming this intimate mixture, the components are melted, mixed together, and held at a temperature of from 140° to 160° F. The intimate mixture is loaded onto the top substrate sheet such that approximately 4.4 grams of the mixture is imparted to the sheet in rows of small dots.

The outer edges of the two substrate sheets are then bonded together by heat sealing, such that the spots of the static-control agent/dispersion inhibitor mixture are on the outside of the finished article, and the detergent composition coating is contained between the substrate sheets. This substrate article provides excellent cleaning, together with fabric softening and static control benefits, when it is placed in an automatic washing machine with a load of soiled fabrics during the washing cycle, and is subsequently transferred, at the conclusion of the wash cycle, to an automatic dryer and dried with the fabrics.

In addition to providing excellent cleaning, static control and fabric softening benefits, the substrate articles described are convenient to use, easy to store, and are not unsatisfactorily sticky when they are handled by the user.

Substantially similar results are obtained when the substrate used in the above example is replaced by one made of the same material, having dimensions of 8"×11", 8"×6", 8"×5½", and 4"×6". In addition, substantially similar cleaning and handling results are obtained where the substrate material used in the above example is replaced by polypropylene materials having air permeabilities of about 19, 25, 40, 50, 70, 100, 125 or 175 cubic feet per minute per square foot.

EXAMPLE VI

A substrate article of the present invention, containing the detergent and static-control compositions described below, is made by the following method:

| Component | % By Weight |
|---|---|
| Detergent composition: | |
| Sodium $C_{11.8}$ alkylbenzene sulfonate | 13.2 |
| $C_{14-16}$ ethoxylated alkyl sulfate | 6.9 |
| Sodium silicate solids (2.0r) | 13.2 |
| Tallow fatty acid | 0.55 |
| Sodium tripolyphosphate | 26.9 |
| Moisture and minors | 34.15 |
| Softening and static control mixture: | |
| Ditallowalkyldimethylammonium methyl sulfate | 1.1 |
| Sorbitan monostearate | 2.7 |
| Tallow alcohol | 1.3 |

An intimate mixture of the ditallowalkyldimethylammonium methyl sulfate, sorbitan monostearate, and tallow alcohol components is made by a mixing and comelting process. A 2" wide strip of this mixture is loaded on one edge of a Scott 8050 Industrial Towel, having an air permeability of about 135–150 cubic ft. per minute per sq. ft., a thickness of about 44 mils, and a substrate basis weight of 77.5 grams per square yard, using a gravure printing process. The towel is then cut into 8"×10¾" sheets, each containing the 2" wide softening and static control strip. One sheet, used as the bottom substrate sheet, is loaded with about 70 grams of the detergent composition, spread in a thin layer on the side opposite to the side carrying the intimate mixture strip, leaving a clean ½" permimeter edge around the substrate sheet. A second sheet of the towel is then laid on top of the detergent composition, such that the intimate mixture strips are on the outside and on opposite ends of the finished article. The two sheets are then bonded together by sewing them around their outer perimeter edges. The final substrate article contains about 3.6 grams of the softening and static control mixture.

This substrate article gives particularly beneficial cleaning, and static-control performance when used sequentially in an automatic washing machine and an automatic clothes dryer in the normal course of the laundering process. Further, the article provides a neat, convenient and efficient way to add detergent and softening/static-control compositions to the wash in a single operation without the necessity of measuring out each of the compositions involved.

What is claimed is:

1. An article useful in a process for cleaning fabrics, yielding sequential release of surfaceactive components, consisting essentially of an effective amount of a surface-active composition comprising from about 5 to 95% of a water-soluble surface-active agent contained between two layers of a water-insoluble, wet-strength substrate, at least one of said layers having areas of different air permeability, at least a substantial portion of said layers having an air permeability of at least about 30 cubic ft. per minute per sq. ft., and a portion of said layers having an air permeability of less than about 10 cubic ft. per minute per sq. ft.

2. An article according to claim 1 wherein at least a substantial portion of the substrate has an air permeability of at least about 70 cubic ft. per minute per sq. ft.

3. An article according to claim 1 wherein the article additionally contains fabric softening and static control components.

4. An article according to claim 3 wherein the fabric softening and static control components are contained in the portion of said layers of lower air permeability and are not released into the laundry solution until the rinse cycle.

* * * * *